US008016520B2

(12) United States Patent
Dybvik et al.

(10) Patent No.: US 8,016,520 B2
(45) Date of Patent: Sep. 13, 2011

(54) CONNECTOR FOR RELEASABLE CONNECTION BETWEEN AN ANCHORAGE IN THE FORM OF A FEMALE PART ARRANGED ON A FLOATING MEANS AND A MALE PART FORMED AT THE END OF A RETRIEVABLE UMBILICAL

(75) Inventors: Jorgen Dybvik, Oslo (NO); Jan Erik Syljeset, Elverum (NO); Arild Figenschou, Billingstad (NO); Bjorn Paulshus, Skedsmokorset (NO)

(73) Assignee: Aker Kvaerner Subsea AS, Lysaker (NO)

( * ) Notice: Subject to any disclaimer, the term of this patent is extended or adjusted under 35 U.S.C. 154(b) by 711 days.

(21) Appl. No.: 11/547,075

(22) PCT Filed: Mar. 30, 2005

(86) PCT No.: PCT/NO2005/000110

§ 371 (c)(1),
(2), (4) Date: Oct. 6, 2008

(87) PCT Pub. No.: WO2005/095198

PCT Pub. Date: Oct. 13, 2005

(65) Prior Publication Data

US 2009/0020061 A1 Jan. 22, 2009

(30) Foreign Application Priority Data

Mar. 31, 2004 (NO) ..... 20041348

(51) Int. Cl.
*E21B 17/01* (2006.01)
*E21B 43/01* (2006.01)
*B63B 21/50* (2006.01)
*B63B 27/24* (2006.01)

(52) U.S. Cl. ..... 405/224; 405/224.2; 166/345; 166/359; 166/367; 114/293

(58) Field of Classification Search ..... 114/230.12, 114/230.13, 230.25–230.29, 293; 166/338–345, 166/350, 359, 367; 405/169, 170, 195.1, 405/223.1, 224, 224.1–224.4
See application file for complete search history.

(56) References Cited

U.S. PATENT DOCUMENTS 4,808,034 A 2/1989 Birch et al.
(Continued)

FOREIGN PATENT DOCUMENTS

WO WO-93/24733 A1 12/1993

*Primary Examiner* — Ajay Vasudeva
(74) *Attorney, Agent, or Firm* — Birch, Stewart, Kolasch & Birch, LLP

(57) ABSTRACT

A connector (10) for releasable connection between an anchorage in the form of a female part (1) arranged on a floating means and a male part (2) formed at the end of a retrievable umbilical (3) provided with a bend stiffener (4) is disclosed. The male part (2) comprises a mandrel body (5) having a pulling head (6) for connection to a pulling means at one end and the umbilical (3) at the other end. The male part (2) comprises a sleeve formed body (7) that is fixed to the mandrel body (5) by shearable elements (8). The bend stiffener (4) is fixed directly to the sleeve formed body (7) and is designed for abutment against and parking together with the bend stiffener (4) within the female part (1) while the remaining part of the male part (2) including the umbilical (3) is designed to be pulled further up through the female part (1) for fluid communication and connection on a floating means or a vessel.

9 Claims, 5 Drawing Sheets

Figure 1:
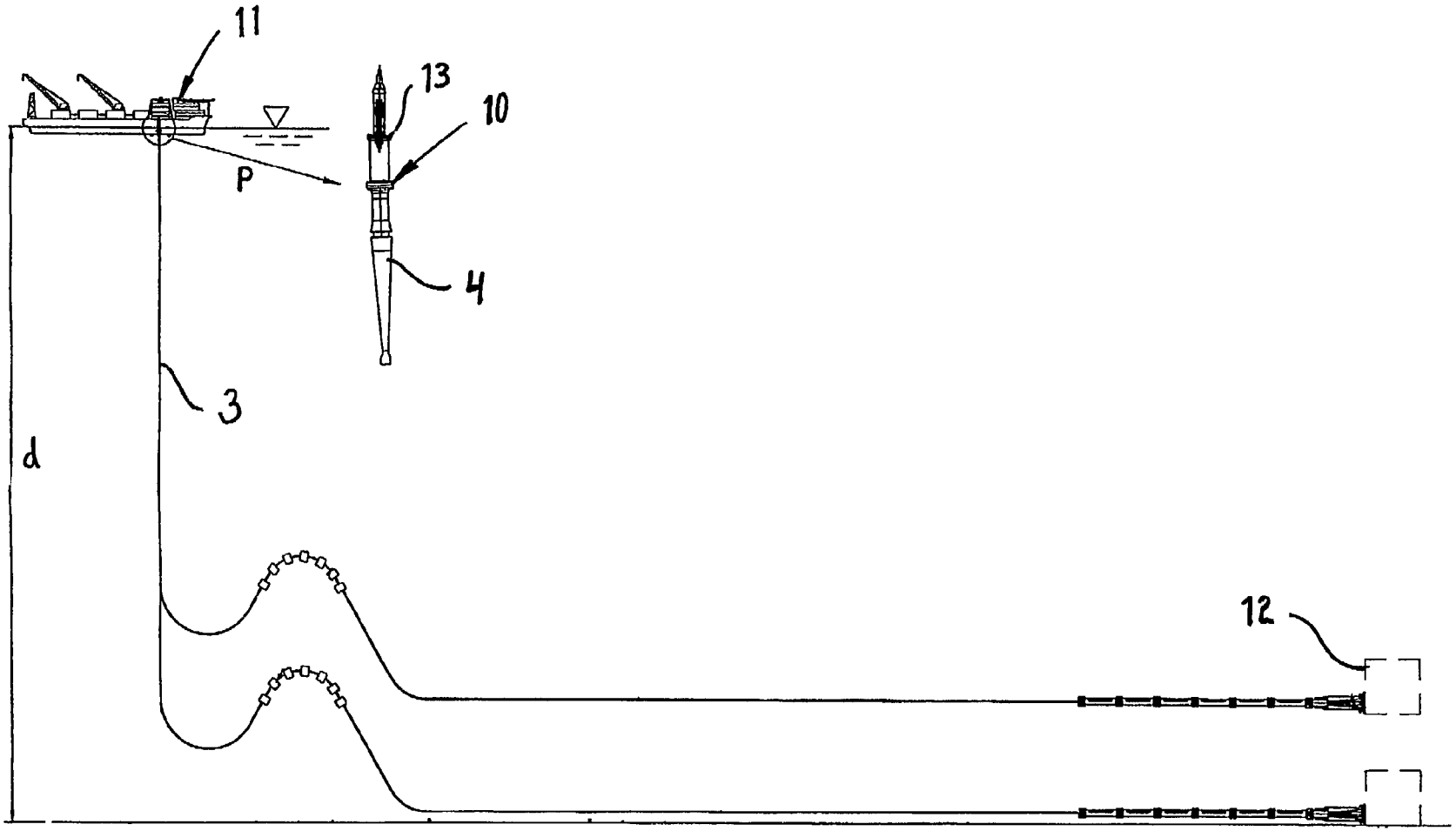

U.S. PATENT DOCUMENTS 5,437,518 A * 8/1995 Maloberti et al. ..... 405/169
5,947,642 A 9/1999 Teixeira et al.
6,155,193 A 12/2000 Syvertsen et al.
6,536,527 B2 * 3/2003 Munk et al. ..... 166/345
6,558,084 B2 * 5/2003 Moog et al. ..... 405/224
7,373,986 B2 * 5/2008 Pollack et al. ..... 166/359

* cited by examiner

CONNECTOR FOR RELEASABLE CONNECTION BETWEEN AN ANCHORAGE IN THE FORM OF A FEMALE PART ARRANGED ON A FLOATING MEANS AND A MALE PART FORMED AT THE END OF A RETRIEVABLE UMBILICAL

The present invention relates to a marine connector for releasable connection between an anchoring in the form of a female part arranged on a floating means and a male part formed at the end of a retrievable umbilical provided with a bend stiffener in which the male part comprises a mandrel body having a pulling head for connection to a pulling means at one end and the umbilical at the other end, a sleeve formed body that is fixed to the mandrel body by shearable elements and the bend stiffener is fixed directly to the sleeve formed body, said sleeve formed body is designed for abutment against and parking together with the bend stiffener within the female part while the remaining part of the male part, including the umbilical, is designed to be pulled further up through the female part for connection and fluid communication on the floating means.

The connector is designed to enable diver less connection and disconnection between a bend stiffener and an anchoring point onboard a floating means, such as a vessel or rig. The bend stiffener is initially arranged around the umbilical and accompanies this till the anchoring point. The bend stiffener becomes parked at the anchoring point while the umbilical, following a particular procedure, is released from the bend stiffener and pulled further up through this. Up today it has been common that divers have had to descend into the water in order to make these connecting operations.

The bend stiffener has the function that it shall prevent too large cyclic bends in the umbilical at the transition zone between sea and air caused by motions of the vessel produced by waves, wind and sea currents. Bend stiffeners can be up to fifteen meters long and, as said, shall prevent fatigue damage on the umbilical.

The anchoring point has the configuration of a female part and is normally arranged at the lower end of a hollow J-formed pipe that is secured externally to the side face of the floating means. The female part and the lower part of the J-formed pipe are normally submerged into the water and thus are stationary arranged relative to the vessel. The connector can be used repeatedly, but need to be prepared each time. The lower end of the J-formed pipe is oriented in a predetermined direction that is adapted to the pull-in direction of the umbilical.

According to the present invention a connector of the introductory said kind is provided, which is distinguished by the fact that the sleeve configured body in its leading end comprises a number of resilient collar fingers co-operating with the female part and for axial fixation of the sleeve configured body and the bend stiffener to the female part.

Preferably the mandrel body includes a shoulder that is releasable fixed to the pulling head.

The releasable shoulder can be made up by two halves or a number of segments.

The shoulder on the mandrel body is preferably designed for co-operation with the resilient collar fingers during a possible later release of the sleeve configured body and the bend stiffener from the female part.

The sleeve configured body may also include an external shoulder for centering within the female part.

The mandrel body may have arresting means at its lower end that are able to prevent that the sleeve configured body and the bend stiffener rush down the umbilical during a potential release operation as discussed above.

Each arresting means can be spring loaded arranged and being able to pass an obstacle in one direction, but not in opposite direction.

Further, each shearable element may be provided radially through the wall to the sleeve configured element.

Each shearable element can in one embodiment be radially moveable through said wall and each shearable element may have a weakness spot that are exposed for the shearable forces when the sleeve configured element has reached predetermined location within the female part.

Figure 2:
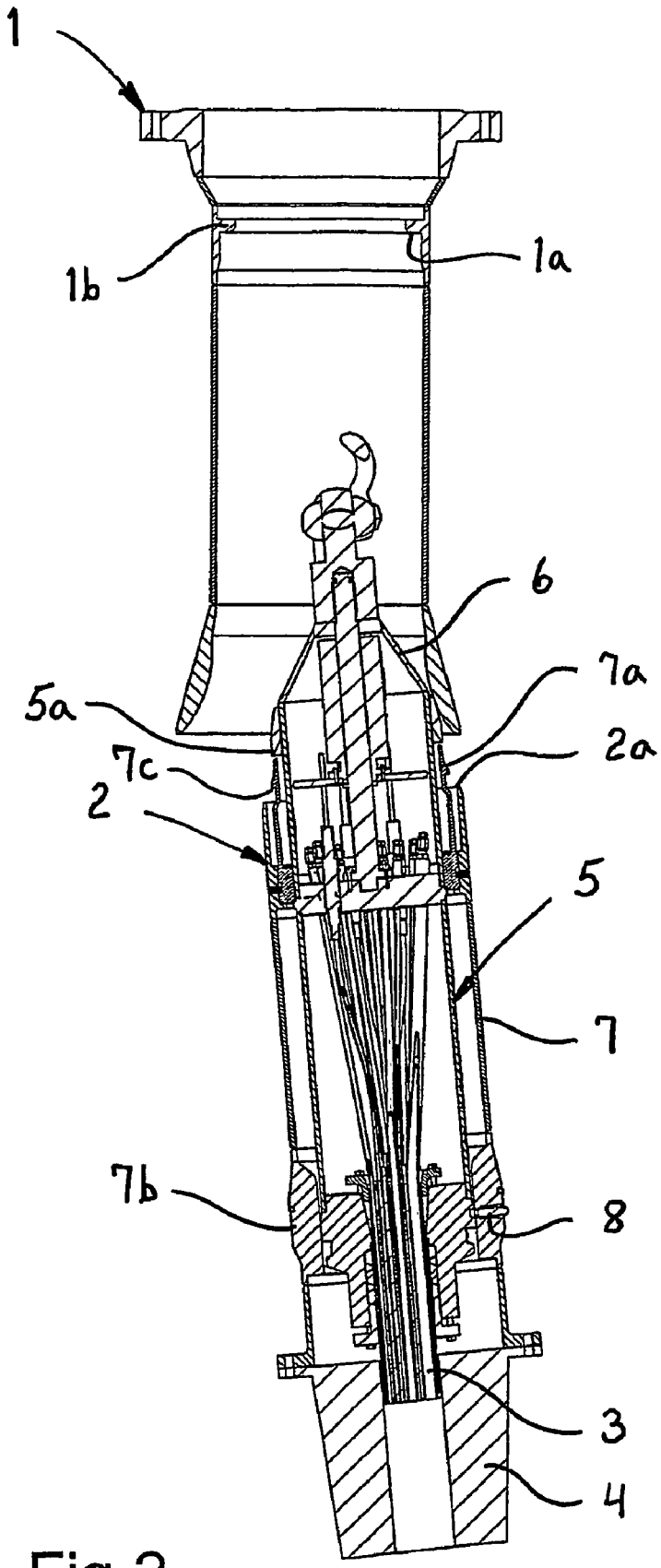
Figure 3E:
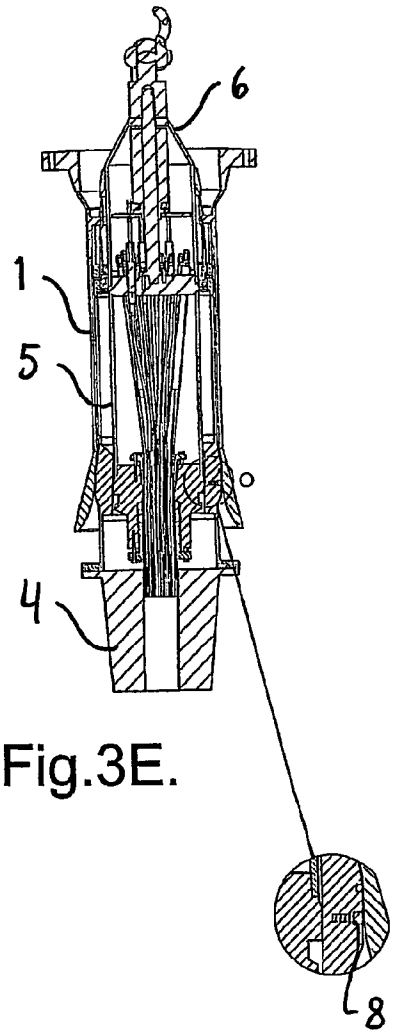
Figure 3D:
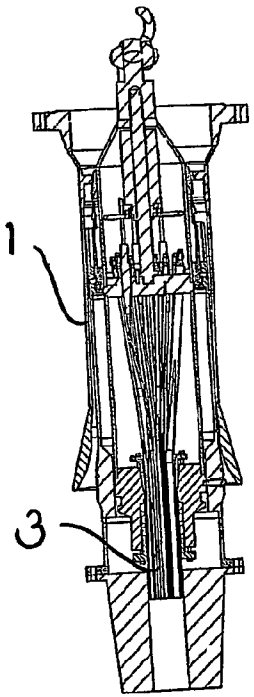
Figure 3C:
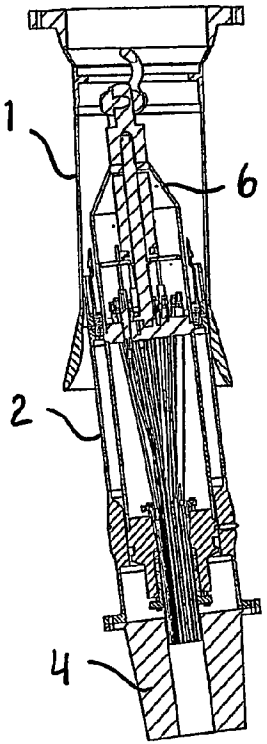
Figure 3B:
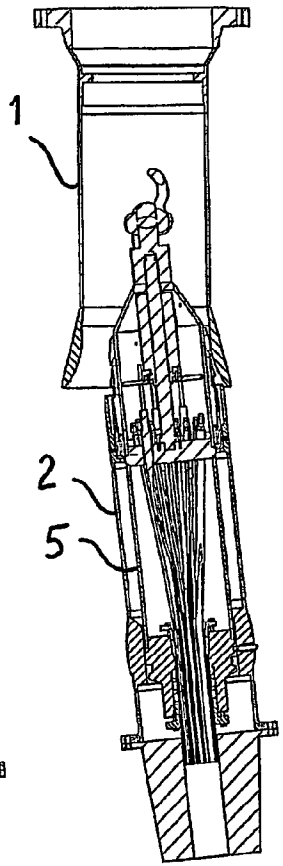
Figure 3A:
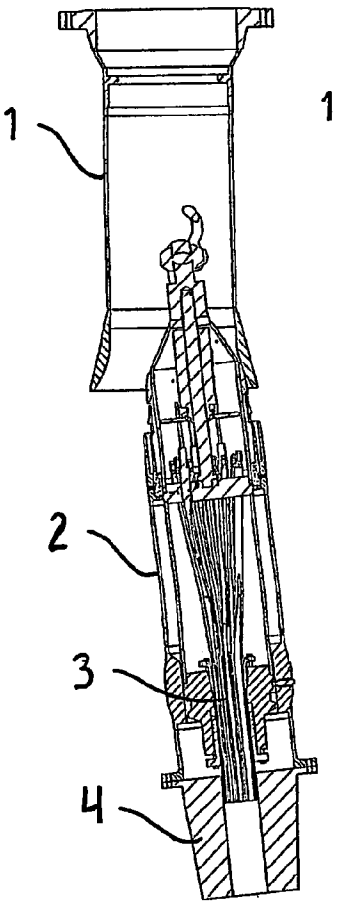
Figure 4A:
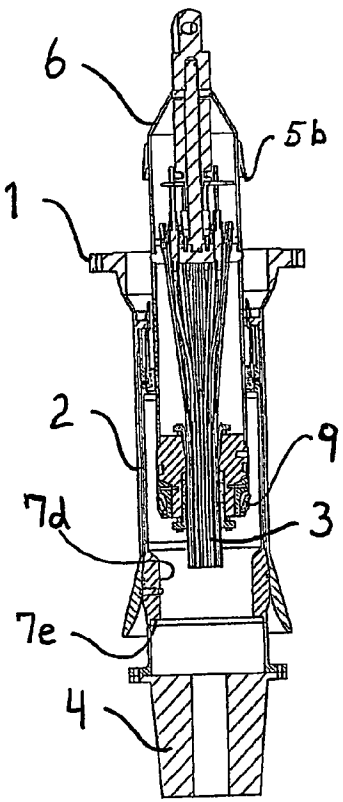
Figure 4B:
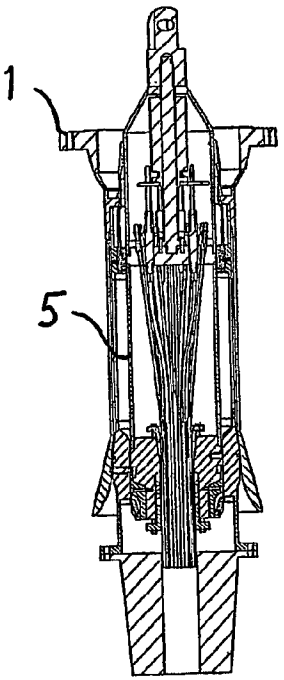
Figure 4C:
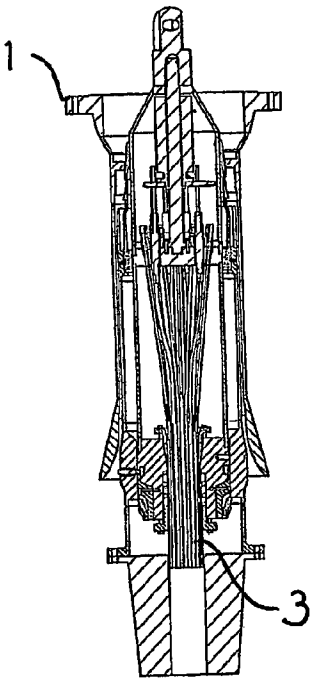
Figure 4D:
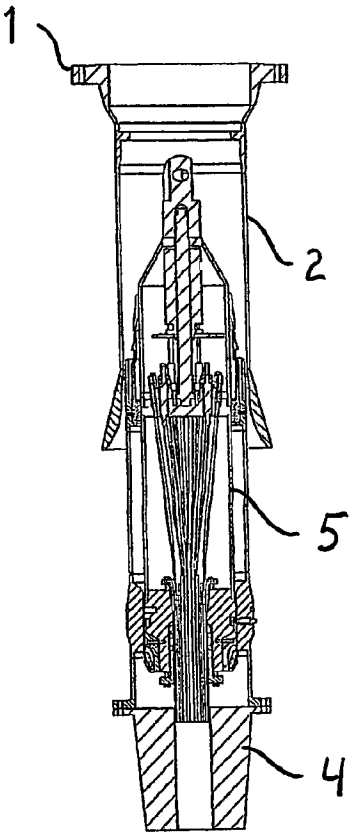
Figure 5:
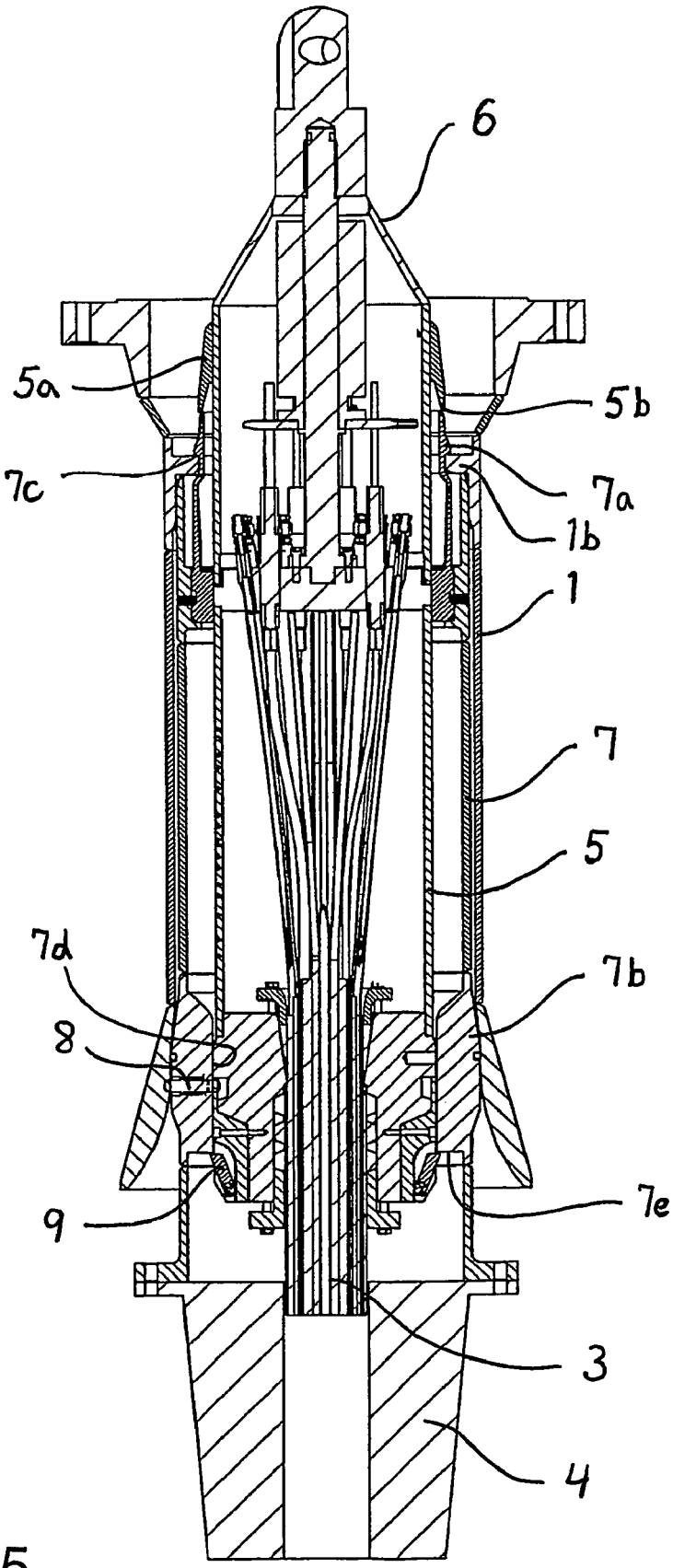

Other and further objects, features and advantages will appear from the following description of one for the time being preferred embodiment of the invention, which is given for the purpose of description and given in context with the appended drawings where:

FIG. 1 shows the environment in which the connector according to the invention is located in use, FIG. 2 shows in longitudinal section the connector according to the invention in an initial puling-in phase, FIG. 3A-3E show the connector according to FIG. 2 in further steps during a pulling-in phase, FIG. 4A-4D show the connector according to FIG. 1 in various phases during release of the connector parts, and FIG. 5 shows FIG. 4B in enlarged scale.

Reference is firstly made to FIG. 1 showing the environment in which the connector 10 according to the invention normally is located in use. A vessel 11 is shown on the sea surface and an umbilical 3 extending down toward the sea bed and extends along this to a dedicated connecting point 12. The sea depth d can be more than 1000 meters. The umbilical 3 is frequently suspended in a catenarian configuration like that illustrated in the figure. In the encircled part of FIG. 1 the connector 10 is located. The connector 10 is shown in larger scale at the end of the arrow P from said circle. The connector 10 is made up by the bend stiffener 4 and a suspension point 13 in top.

Reference is now made to FIG. 2 showing the respective connector parts in closer detail. The connector 10 comprises a female part 1 and a male part 2. The female part 1 is normally provided in the lower end of a hollow J-formed pipe (not shown) that is secured externally to the side face of a floating means or a vessel 11 and extends substantially vertically up to the deck level of the floating means. The female part 1 and the lower part of the J-formed pipe are normally submerged in the water and can be considered as stationary arranged relative to the vessel 11. The connector 10 can be used repeatedly, but need to be prepared each time. The lower end of the J-formed pipe is oriented in a particular direction adapted to the direction in which an umbilical 3 is to be pulled in.

The male part 2 is provided in the end of the retrievable umbilical 3 which is provided with the bend stiffener 4 enclosing the umbilical 3 over a certain longitudinal extension. The male part 2 comprises a mandrel body 5 having a pulling head 6 for connection to a pulling means (not shown), such as a wire line or similar, at one end and the umbilical 3 at the other end.

Further the male part 2 includes a sleeve configured body 7 that is fixed to the mandrel body 5 by means of a number of shearable elements 8. The bend stiffener 4 is in turn fixed directly to the sleeve configured body 7. The sleeve configured body 7 is designed for abutment against an internal stop ledge 1*a* within the female part 1 for parking together with the bend stiffener 4 within the female part 1. The remaining part of the male part 2, i.e. the mandrel body 5 including the pulling head 6 and the umbilical 3, is designed to be pulled further up through the female part 1 for connection and fluid communication on a floating means or vessel 11.

The male part 2 has an upper stop surface 2*a* which shall hit and act against the stop ledge 1*a* within the female part 1.

The sleeve configured body 7 has in its leading end a number of resilient collar fingers 7*a* which are designed to co-act or engage with an internal ring flange 1*b* within the female part 1. Thus the sleeve configured body 7 and the bend stiffener 4 can be axially retained to the female part 1.

Each shearable element 8 is arranged radially through the wall of the sleeve configured body 7. Each shearable element 8 is further radially displaceable through said wall. Each shearable element 8 has a weakness point exposed for the shearable forces when the sleeve configured body 7 has reached predetermined location within the female part 1. The predetermined location is, in practice, when the upper stop surface 2*a* of the male part 2 abuts against the stop ledge 1*a* within the female part 1 approximately simultaneously to the locking by means of snapping action of the collar fingers 7*a* to the internal ring flange 1*b* within the female part 1.

The mandrel body 5 also includes a shoulder 5*a* that is releasable provided on the pulling head 6. The releasable shoulder 5*a* is normally made up by two halves which are screwed fixedly to the mandrel body 5. This shoulder 5*a* needs, in fact, not be assembled until a later time, should one initiate an operation for disconnecting the connector again.

The sleeve configured body 7 can preferably include an external shoulder 7*b* at its lower end, or an enlargement for centering within the female part 1 during its parking operation.

With reference to FIG. 5 the mandrel body 5 has a number of arresting means 9 in its lower end which, like the shoulder 5*a*, strictly do not need to be mounted until one at a later stage shall initiate an operation to release the connector again. The arresting means 9 act such that they prevent that the sleeve configured body 7 including the bend stiffener 4 rush down the umbilical 3 during a possible later release operation.

Each arresting means 9 are resilient or spring loaded arranged and are able to pass an obstacle in one direction, but not in opposite direction.

FIGS. 3B-3E show further steps of a pull-in operation, which will now be briefly described. FIG. 3A is the same as FIG. 2, but in smaller scale, and is included in order to illustrate a pull-in procedure. As shown in FIGS. 3B and 3C the male part 2 may hit the female part 1 by an angular deviation between their respective longitudinal axes of about 5 degrees. The female part 1 has a flaring form in the lower end thereof in order to facilitate the entering between the parts. As the male part 2 is pulled up through the female part 1 they are brought in line or aligned with each other as illustrated in FIGS. 3C and 3D.

When the male part 2 is completely introduced within the female part 1, the upper stop surface 2*a* of the male part 2 abuts against the stop ledge 1*a* in the female part 1. About at the same time the collar fingers 7*a* lock to the internal ring flange 1*b* in the female part 1. This is illustrated in FIG. 3E. The collar fingers 7*a* are resilient or compliant in radial direction which means that they are able to flex or bend inwardly. The tip of collar fingers 7*a* have external arrowhead configuration. When the tips reach the internal ring flange 1*b* they will be forced radially inwards until a hook 7*c* on the head slips over the ring flange 1*b* and flexes back in a direction outwards. At this the locking takes place by means of a kind of snap action. Thus it is to be understood that the male part 2 in this moment is kept retained to the female part 1 by means of the hooks 7*c* and the upper stop surface 2*a* that act on their respective sides of the ring flange 1*b*.

The male part 2, however, is to be pulled further upward to the deck level of the vessel. The male part 2 now releases its sleeve configured body 7 which remains parked within the female part. This takes place in that the tension in the pulling means (not shown) is increased, while the sleeve formed body 7 is locked to the female part 1, until the shearable elements 8 are sheared, as illustrated in the encircled and enlarged part of FIG. 3E. When the elements 8 are sheared the remaining part of the male part 2, i.e. the mandrel body 5 including the pulling head 6 and umbilical 3, continues through the J-formed pipe up to the deck level of the vessel. There the pulling head 6 is disassembled in order to get access to the end of the umbilical 3 having respective pipe fittings for further connection to respective fluid pipes onboard.

If it at a later occasion becomes necessary to disconnect the connector a procedure is to be followed which is illustrated in FIG. 4A-4D and will be described below.

Subsequent to the disconnection between the pipes in the mandrel body 5 and the respective fluid pipes onboard, the pulling head 6 is assembled and the pulling means, such as a wire line, is secured to the pulling head 6. Lowering of the mandrel body 5, including the pulling head 6 and the umbilical 3, may now commence by dropping this down through the J-formed pipe and down toward the, relative to the vessel, stationary female part 1, as shown in FIG. 4A.

During the further lowering the mandrel body 5 is to release the sleeve configured body 7 from the female part 1. This takes place in the following way. Now the releasably arranged shoulder 5*a* on the pulling head 6 comes into use. The shoulder 5*a* has an internal cone shape that tapers upwards. As shown in FIG. 4B the lower edge 5*b* of the shoulder 5*a* hits the respective tips of the collar fingers 7*a* and in such a way that the edge 5*b* guides the collar fingers into the cone shape, which again results in that the collar fingers 7*a* are forced radially inward which again leads to that the hook 7*c* of the collar fingers 7*a* disengage from the ring flange 1*b*. By this the sleeve configured body 7 is released from its engagement with the female part 1 and can, together with the bend stiffener 4, follow the umbilical 3, as illustrated in the first phase in FIG. 4C and in the last phase before exit from the female part 1 in FIG. 4D.

Simultaneously with the above described, the arresting means 9 are engaged. When the arresting means 9 are guided down through the sleeve configured body 7 they will subsequently hit an internal restriction 7*d* in the lower end of the sleeve configured body 7, see FIG. 4A. The restriction 7*d* forces the arresting means 9 resiliently inwards. The restriction 7*d* terminates in an internal shoulder 7*e*. When the arresting means 9 is passing the internal shoulder 7*e*, the arresting means 9 bounce out again. This takes place about simultaneously with, though just before, that the collar fingers 7*a* are released from the internal ring flange 1*b* by means of said shoulder 5*a* on the mandrel body 5 as described above.

As mentioned earlier, the arresting means 9 will act such that they prevent the sleeve configured body 7 including the bend stiffener 4 to rush down the umbilical 3 in an uncontrolled way during this release operation.

The invention claimed is:

1. A connector for releasable connection between an anchoring in the form of a female part (1) arranged on a floating means and a male part (2) formed at the end of a retrievable umbilical (3) provided with a bend stiffener (4), which male part (2) comprises a mandrel body (5) having a pulling head (6) for connection to a pulling means at one end and the umbilical (3) at the other end, a sleeve formed body (7) that is fixed to the mandrel body (5) by shearable elements (8), and the bend stiffener (4) is fixed directly to the sleeve formed body (7), said sleeve formed body (7) being designed for abutment against and parking together with the bend stiffener (4) within the female part (1) while the remaining portion of the male part (2) including the umbilical (3), is designed to be pulled further up through the female part (1) for connection and fluid communication on the floating means, characterized in that the sleeve formed body (7) in the leading end thereof comprises a number of resilient collar fingers (7*a*) for cooperation with the female part (1) and axial fixation of the sleeve formed body (7) and the bend stiffener (4) to the female part (1).

2. The connector according to claim 1, characterized in that the mandrel body (5) comprises a shoulder (5*a*) releasably provided on the pulling head (6).

3. The connector according to claim 2, characterized in that the releasable shoulder (5*a*) is made up by two halves, alternatively a number of segments.

4. The connector according to claim 2, characterized in that said shoulder (5*a*) on the mandrel body (5) is designed to co-operate with the resilient collar fingers (7*a*) by a possible later release of the sleeve formed body (7) and the bend stiffener (4) from the female part (1).

5. The connector according to claim 1, characterized in that the sleeve formed body (7) comprises an external shoulder (7*b*) for centering within the female part (1).

6. The connector according to claim 1, characterized in that the mandrel body (5) in its lower end comprises arresting means (9), which arresting means (9) is able to prevent that the sleeve formed body (7) including the bend stiffener (4) rush down the umbilical (3) during a possible release according to claim 5.

7. The connector according to claim 6, characterized in that each arresting means (9) is spring loaded and able to pass an obstacle in one direction, but not in opposite direction.

8. The connector according to claim 1, characterized in that each shearable element (8) is arranged radially through the wall of the sleeve formed body (7).

9. The connector according to claim 8, characterized in that each shearable element (8) is radially displaceable through said wall of the sleeve formed body (7) and that each shearable element (8) has a weakening point that is exposed to the shearable forces when the sleeve formed body (7) has reached predetermined location within the female part (1).

* * * * *